US012747911B2

(12) United States Patent
Kim et al.

(10) Patent No.: US 12,747,911 B2
(45) Date of Patent: Sep. 29, 2026

(54) HYDROGEN LIQUEFACTION SYSTEM AND HYDROGEN LIQUEFACTION METHOD

(71) Applicant: H2CREO Corp., Dover, DE (US)

(72) Inventors: Hyung Jin Kim, Gyeonggi-do (KR); Sung Yong Kim, Gyeonggi-do (KR); Jong H Baik, Titusville, FL (US)

(73) Assignee: H2CREO Corp., Dover, DE (US)

( * ) Notice: Subject to any disclaimer, the term of this patent is extended or adjusted under 35 U.S.C. 154(b) by 275 days.

(21) Appl. No.: 18/590,439

(22) Filed: Feb. 28, 2024

(65) Prior Publication Data

US 2024/0318906 A1 Sep. 26, 2024

Related U.S. Application Data

(60) Provisional application No. 63/454,156, filed on Mar. 23, 2023.

(51) Int. Cl.
*F25J 1/00* (2006.01)
*F25J 1/02* (2006.01)

(52) U.S. Cl.
CPC ..... *F25J 1/001* (2013.01); *F25J 1/0017* (2013.01); *F25J 1/005* (2013.01); *F25J 1/0065* (2013.01); *F25J 1/0072* (2013.01); *F25J 1/0205* (2013.01); *F25J 2205/86* (2013.01); *F25J 2210/02* (2013.01); *F25J 2230/04* (2013.01); *F25J 2270/12* (2013.01); *F25J 2270/14* (2013.01)

(58) Field of Classification Search
None
See application file for complete search history.

(56) References Cited

U.S. PATENT DOCUMENTS 3,116,115 A * 12/1963 Kasparian ..... F25J 1/0224 423/649
3,992,167 A * 11/1976 Beddome ..... F25J 1/025 505/895

(Continued)

FOREIGN PATENT DOCUMENTS

CN 112361712 A * 2/2021 ..... F25J 1/0279
CN 114087845 A * 2/2022 ..... F25J 1/001

(Continued)

OTHER PUBLICATIONS

EP 4001462 A1 Foreign Document and Machine Translation (Year: 2022).*

*Primary Examiner* — Jenna M Maroney
(74) *Attorney, Agent, or Firm* — Moser Taboada

(57) ABSTRACT

A hydrogen liquefaction system comprises a hydrogen pipe, where gaseous hydrogen is introduced at a front end, heat exchange occurs in a first heat exchange unit leading to liquefaction of gaseous hydrogen into liquid hydrogen; a pre-cooling device formed between the front end of the hydrogen pipe and the first heat exchange unit; an oxygen pipe, where gaseous oxygen is introduced at a front end, heat exchange occurs in the pre-cooling device leading to liquefaction of gaseous oxygen into liquid oxygen; and a heat exchange device, which is in thermal contact with the first heat exchange unit of the hydrogen pipe so as to perform heat exchange with the first heat exchange unit of the hydrogen pipe such that pre-cooled gaseous hydrogen can be liquefied into liquid hydrogen.

18 Claims, 5 Drawing Sheets

(56) References Cited

U.S. PATENT DOCUMENTS

| | | | | | |
|---|---|---|---|---|---|
| 4,765,813 | A * | 8/1988 | Gaumer, Jr. | F25J 1/0221 | 62/912 |
| 5,580,793 | A * | 12/1996 | Wanner | G01N 7/00 | 422/62 |
| 6,374,617 | B1 * | 4/2002 | Bonaquist | F25J 1/0225 | 60/520 |
| 8,042,357 | B2 * | 10/2011 | Schwartz | C01B 3/0089 | 62/607 |
| 2010/0272634 | A1 * | 10/2010 | Schwartz | C01B 3/0089 | 422/187 |
| 2016/0231049 | A1 * | 8/2016 | Baik | F28D 15/0233 | |
| 2017/0205140 | A1 * | 7/2017 | Kim | F25J 1/0272 | |
| 2022/0221220 | A1 * | 7/2022 | Thomas | F25J 1/0035 | |
| 2023/0147955 | A1 * | 5/2023 | Schwartz | F25J 1/0232 | 62/607 |
| 2023/0213277 | A1 * | 7/2023 | Fink | F25J 1/0022 | 62/611 |
| 2024/0175627 | A1 * | 5/2024 | Baik | F25J 1/005 | |
| 2024/0318904 | A1 * | 9/2024 | Baik | F25J 1/0259 | |
| 2024/0318908 | A1 * | 9/2024 | Baik | F25J 1/0221 | |
| 2024/0393041 | A1 * | 11/2024 | Gaertner | F25J 1/0215 | |

FOREIGN PATENT DOCUMENTS

| | | | | | |
|---|---|---|---|---|---|
| CN | 114214637 | B | * | 6/2024 | F25J 1/0221 |
| DE | 102014018427 | A1 | * | 6/2016 | F25J 1/0052 |
| GB | 2142423 | A | * | 1/1985 | F25J 1/0035 |
| GB | 2142423 | B | * | 8/1986 | F25J 1/0268 |
| GB | 2234054 | A | * | 1/1991 | C25B 1/04 |
| JP | 2007205667 | A | * | 8/2007 | F25J 1/0228 |
| JP | 2021-169872 | A | | 10/2021 | |
| JP | 2023063695 | A | * | 5/2023 | F25J 1/001 |
| KR | 10-0310819 | B1 | | 12/2001 | |
| KR | 101458098 | B1 | * | 11/2014 | F25J 1/001 |
| KR | 20210072985 | A | * | 6/2021 | F25J 1/0261 |
| WO | WO-9008295 | A1 | * | 7/1990 | C25B 1/02 |
| WO | WO 2022/096262 | A1 | | 5/2022 | |
| WO | WO-2025013591 | A1 | * | 1/2025 | F25J 1/0244 |

* cited by examiner

HYDROGEN LIQUEFACTION SYSTEM AND HYDROGEN LIQUEFACTION METHOD

CROSS-REFERENCE TO RELATED APPLICATIONS

The present application claims the benefit of and priority to U.S. Provisional Application Ser. No. 63/454,156, filed on Mar. 23, 2023, the entire contents of which is incorporated herein by reference.

BACKGROUND

1. Field of the Invention

The present disclosure relates to a hydrogen liquefaction system and a hydrogen liquefaction method, and more particularly, to a hydrogen liquefaction system and a hydrogen liquefaction method capable of liquefying oxygen produced as a by-product in a pre-cooling process to increase an amount of liquefied hydrogen produced through water electrolysis.

2. Description of the Related Art

Conventionally, fossil fuels such as oil, coal, and natural gas have been primarily used as energy sources. However, these resources have the disadvantage of being finite and emitting carbon compounds that contribute to global warming. Therefore, technologies are being developed to utilize hydrogen as an energy source. Hydrogen can produce electricity in an eco-friendly and efficient manner, presents no risk of depletion, is sustainable, and offers advantages in terms of ease of storage and transport.

As such, various methods are employed to produce hydrogen for utilizing hydrogen energy as a solution to global warming resulting from the use of fossil fuels. Among these methods, electrolyzing water using renewable energy to produce hydrogen is gaining attention as a clean energy solution.

Meanwhile, in order to more efficiently transport and store hydrogen produced by electrolysis, various systems exist to liquefy gaseous hydrogen. Generally, most hydrogen liquefaction systems liquefy gaseous hydrogen through a multi-stage heat exchange process. In this hydrogen liquefaction system, a system for pre-cooling gaseous hydrogen using liquid nitrogen is used together to increase an amount of liquefied hydrogen.

However, conventional water electrolysis systems and hydrogen liquefaction systems face an issue where only gaseous hydrogen produced during water electrolysis is liquefied, while gaseous oxygen, generated as a by-product, remains unutilized and is vented into the air, despite its mass being up to eight times that of hydrogen. Additionally, installing a separate cryogenic air separation unit to liquefy gaseous oxygen poses challenges such as restrictions on installation locations and additional costs.

SUMMARY

The present disclosure is intended to solve various problems including the above problems, and has a purpose to provide a hydrogen liquefaction system and a hydrogen liquefaction method capable of simultaneously liquefying gaseous oxygen in a pre-cooling process to increase an amount of liquefied hydrogen by connecting a separate oxygen pipe, in which heat exchange can occur, to a pre-cooling device so as to pass through the pre-cooling device that pre-cools gaseous hydrogen using liquid nitrogen. However, these issues are exemplary, and a scope of the present disclosure is not limited thereto.

According to an embodiment of the present disclosure, a hydrogen liquefaction system is provided. The hydrogen liquefaction system may comprise a hydrogen pipe, where gaseous hydrogen is introduced at a front end, heat exchange occurs in a first heat exchange unit leading to liquefaction of gaseous hydrogen into liquid hydrogen, and liquefied liquid hydrogen can be discharged at a rear end; a pre-cooling device formed between the front end of the hydrogen pipe and the first heat exchange unit, pre-cooling gaseous hydrogen; an oxygen pipe, where gaseous oxygen is introduced at a front end, heat exchange occurs in the pre-cooling device leading to liquefaction of gaseous oxygen into liquid oxygen, and liquefied liquid oxygen can be discharged at a rear end; and a heat exchange device, which is in thermal contact with the first heat exchange unit of the hydrogen pipe so as to perform heat exchange with the first heat exchange unit of the hydrogen pipe such that pre-cooled gaseous hydrogen can be liquefied into liquid hydrogen.

According to an example of the present disclosure, the pre-cooling device may use low-temperature liquid nitrogen, or latent heat that is generated when liquid nitrogen is vaporized into gaseous nitrogen, to pre-cool gaseous hydrogen and liquefy gaseous oxygen into liquid oxygen.

According to an example of the present disclosure, the pre-cooling device may be in thermal contact with the hydrogen pipe and the oxygen pipe so as to perform heat exchange with the hydrogen pipe and the oxygen pipe, and have one side from which liquid nitrogen is supplied and other side to which gaseous nitrogen is discharged, by a nitrogen circulating line where heat exchange occurs in a second heat exchange unit leading to liquefaction of gaseous nitrogen into liquid nitrogen.

According to an example of the present disclosure, the heat exchange device may be in thermal contact with the second heat exchange unit of the nitrogen circulating line so as to perform heat exchange with the second heat exchange unit of the nitrogen circulating line to liquefy gaseous nitrogen into liquid nitrogen.

According to an example of the present disclosure, the pre-cooling device may comprise a heat exchange tank formed to surround at least a part of the hydrogen pipe and the oxygen pipe so as to perform heat exchange with the hydrogen pipe and the oxygen pipe, and having an accommodation space therein so as to accommodate liquid nitrogen; a nitrogen circulating line that connects a lower side and an upper side of the heat exchange tank in a form of a closed loop, and performs heat exchange in a second heat exchange unit leading to liquefaction of gaseous nitrogen into liquid nitrogen such that liquid nitrogen can be supplied to the lower side of the heat exchange tank and gaseous nitrogen can be discharged to the upper side of the heat exchange tank; and an oxygen liquefaction tank formed in the oxygen pipe in the accommodation space of the heat exchange tank, forming a liquefaction space where gaseous oxygen can be liquefied into liquid oxygen by heat exchange with liquid nitrogen that is accommodated in the accommodation space.

According to an example of the present disclosure, the heat exchange tank may comprise an internal tank formed therein; an external tank formed to surround the internal tank so as to be spaced apart from the internal tank; and an insulating material formed between the internal tank and the external tank.

According to an example of the present disclosure, at least a part of the hydrogen pipe may be formed as a spiral section within the accommodation space so as to increase a thermal contact area in contact with liquid nitrogen that is accommodated in the accommodation space of the heat exchange tank.

According to an example of the present disclosure, the pre-cooling device may further comprise a pressure regulator that regulates internal pressure of the accommodation space of the heat exchange tank and internal pressure of the liquefaction space of the oxygen liquefaction tank.

According to an example of the present disclosure, the pressure regulator may comprise a relief valve that is opened to discharge evaporation gas to outside when internal pressure exceeds a predetermined maximum pressure by evaporation gas generated in at least one of the accommodation space of the heat exchange tank and the liquefaction space of the oxygen liquefaction tank.

According to an example of the present disclosure, the pre-cooling device may further comprise a liquid nitrogen supply pipe formed to penetrate the upper side of the heat exchange tank and extend toward the lower side of the heat exchange tank in the accommodation space, supplying liquid nitrogen to the heat exchange tank from outside; and an on-off valve formed in the liquid nitrogen supply pipe so as to control a supply amount of liquid nitrogen that is supplied through the liquid nitrogen supply pipe.

According to an example of the present disclosure, the pre-cooling device may further comprise a level detecting sensor that detects a level of liquid nitrogen that is accommodated in the accommodation space of the heat exchange tank; and a control unit that receives a level signal from the level detecting sensor to apply a control signal to the on-off valve.

According to an example of the present disclosure, the pre-cooling device may further comprise an Ortho-Para (O-P) converter formed in the hydrogen pipe in the accommodation space of the heat exchange tank, converting a ratio of ortho-hydrogen to para-hydrogen in a process of pre-cooling gaseous hydrogen.

According to an example of the present disclosure, the heat exchange device may comprise a helium circulating line in which helium circulates; a compressor formed in the helium circulating line, compressing helium; an aftercooler formed in the helium circulating line, cooling compressed helium to release heat; a first expander formed in the helium circulating line, expanding compressed helium such that temperature of helium is firstly lowered; and a second expander formed in the helium circulating line, expanding compressed helium such that temperature of helium is secondly lowered.

According to an example of the present disclosure, the heat exchange device may further comprise a first heat exchanger formed between the aftercooler and the first expander, performing heat exchange with the nitrogen circulating line and the helium circulating line that enter the compressor; a second heat exchanger formed between the first expander and the second expander, performing heat exchange with the hydrogen pipe; and a third heat exchanger formed between the second expander and the second heat exchanger, performing heat exchange with the hydrogen pipe.

According to an example of the present disclosure, the heat exchange device may comprise a first heat exchanger formed in the nitrogen circulating line, performing heat exchange with the nitrogen circulating line by a cryocooler; and a second heat exchanger formed in the hydrogen pipe, performing heat exchange with the hydrogen pipe by the cryocooler.

According to an example of the present disclosure, the front end of the hydrogen pipe at which gaseous hydrogen is introduced and the front end of the oxygen pipe at which gaseous oxygen is introduced may be connected to an electrolyzer that electrolyzes water to generate gaseous hydrogen and gaseous oxygen.

According to another embodiment of the present disclosure, a hydrogen liquefaction system is provided. The hydrogen liquefaction system may comprise a hydrogen pipe, where gaseous hydrogen is introduced at a front end, heat exchange occurs in a first heat exchange unit leading to liquefaction of gaseous hydrogen into liquid hydrogen, and liquefied liquid hydrogen can be discharged at a rear end; a pre-cooling device formed between the front end of the hydrogen pipe and the first heat exchange unit, pre-cooling gaseous hydrogen; an oxygen pipe, where gaseous oxygen is introduced at a front end, heat exchange occurs in the pre-cooling device leading to liquefaction of gaseous oxygen into liquid oxygen, and liquefied liquid oxygen can be discharged at a rear end; and a heat exchange device, which is in thermal contact with the first heat exchange unit of the hydrogen pipe so as to perform heat exchange with the first heat exchange unit of the hydrogen pipe such that pre-cooled gaseous hydrogen can be liquefied into liquid hydrogen; wherein the pre-cooling device may comprise a heat exchange tank that uses low-temperature liquid nitrogen, or latent heat that is generated when liquid nitrogen is vaporized into gaseous nitrogen, to pre-cool gaseous hydrogen and liquefy gaseous oxygen into liquid oxygen, is formed to surround at least a part of the hydrogen pipe and the oxygen pipe so as to perform heat exchange with the hydrogen pipe and the oxygen pipe, and has an accommodation space therein so as to accommodate liquid nitrogen; a nitrogen circulating line that connects a lower side and an upper side of the heat exchange tank in a form of a closed loop, and performs heat exchange in a second heat exchange unit leading to liquefaction of gaseous nitrogen into liquid nitrogen such that liquid nitrogen can be supplied to the lower side of the heat exchange tank and gaseous nitrogen can be discharged to the upper side of the heat exchange tank; an oxygen liquefaction tank formed in the oxygen pipe in the accommodation space of the heat exchange tank, forming a liquefaction space where gaseous oxygen can be liquefied into liquid oxygen by heat exchange with liquid nitrogen that is accommodated in the accommodation space; a pressure regulator that regulates internal pressure of the accommodation space of the heat exchange tank and internal pressure of the liquefaction space of the oxygen liquefaction tank; a liquid nitrogen supply pipe formed to penetrate the upper side of the heat exchange tank and extend toward the lower side of the heat exchange tank in the accommodation space, supplying liquid nitrogen to the heat exchange tank from outside; an on-off valve formed in the liquid nitrogen supply pipe so as to control a supply amount of liquid nitrogen that is supplied through the liquid nitrogen supply pipe; and an Ortho-Para (O-P) converter formed in the hydrogen pipe in the accommodation space of the heat exchange tank, converting a ratio of ortho-hydrogen to para-hydrogen in a process of pre-cooling gaseous hydrogen; at least a part of the hydrogen pipe may be formed in a spiral shape within the accommodation space so as to increase a thermal contact area in contact with liquid nitrogen that is accommodated in the accommodation space of the heat exchange tank, and the heat exchange device may be in thermal contact with the second heat exchange unit of the nitrogen circulating line so as to perform heat exchange with the second heat exchange unit of the nitrogen circulating line leading to liquefaction of gaseous nitrogen into liquid nitrogen, and perform heat exchange with the first heat exchange unit of the hydrogen pipe and the second heat exchange unit of the nitrogen circulating line by a recuperative cycle and a regenerative cycle.

According to another embodiment of the present disclosure, a hydrogen liquefaction method is provided. The hydrogen liquefaction method may comprise (a) preparing a hydrogen pipe, where gaseous hydrogen is introduced at a front end, heat exchange occurs in a heat exchange unit leading to liquefaction of gaseous hydrogen into liquid hydrogen, and liquefied liquid hydrogen can be discharged at a rear end; (b) preparing an oxygen pipe, where gaseous oxygen is introduced at a front end, heat exchange occurs in the pre-cooling device leading to liquefaction of gaseous oxygen into liquid oxygen, and liquefied liquid oxygen can be discharged at a rear end; (c) pre-cooling gaseous hydrogen between the front end of the hydrogen pipe and the first heat exchange unit by using the pre-cooling device, and liquefying gaseous oxygen into liquid oxygen; and (d) liquefying gaseous pre-cooled hydrogen, which is pre-cooled by performing heat exchange with the first heat exchange unit of the hydrogen pipe by using a heat exchange device that is in thermal contact with the first heat exchange unit of the hydrogen pipe, into liquid hydrogen.

According to an embodiment of the present disclosure configured as described above, it is possible to simultaneously liquefy gaseous oxygen in a pre-cooling process to increase an amount of liquefied hydrogen by connecting a separate oxygen pipe, in which heat exchange can occur, to a pre-cooling device so as to pass through the pre-cooling device that pre-cools gaseous hydrogen using liquid nitrogen.

As such, simple improvement of a pipe connection structure for additional heat exchange in a pre-cooling stage that is used in a liquefaction stage of gaseous hydrogen allows simultaneous pre-cooling of gaseous hydrogen and liquefaction of gaseous oxygen, such that a hydrogen liquefaction system and a hydrogen liquefaction method capable of liquefying gaseous oxygen together which is generated as a by-product during water electrolysis can be implemented at minimal cost without additional equipment. However, a scope of the present disclosure is not limited by these effects.

DETAILED DESCRIPTION

Figure 1:
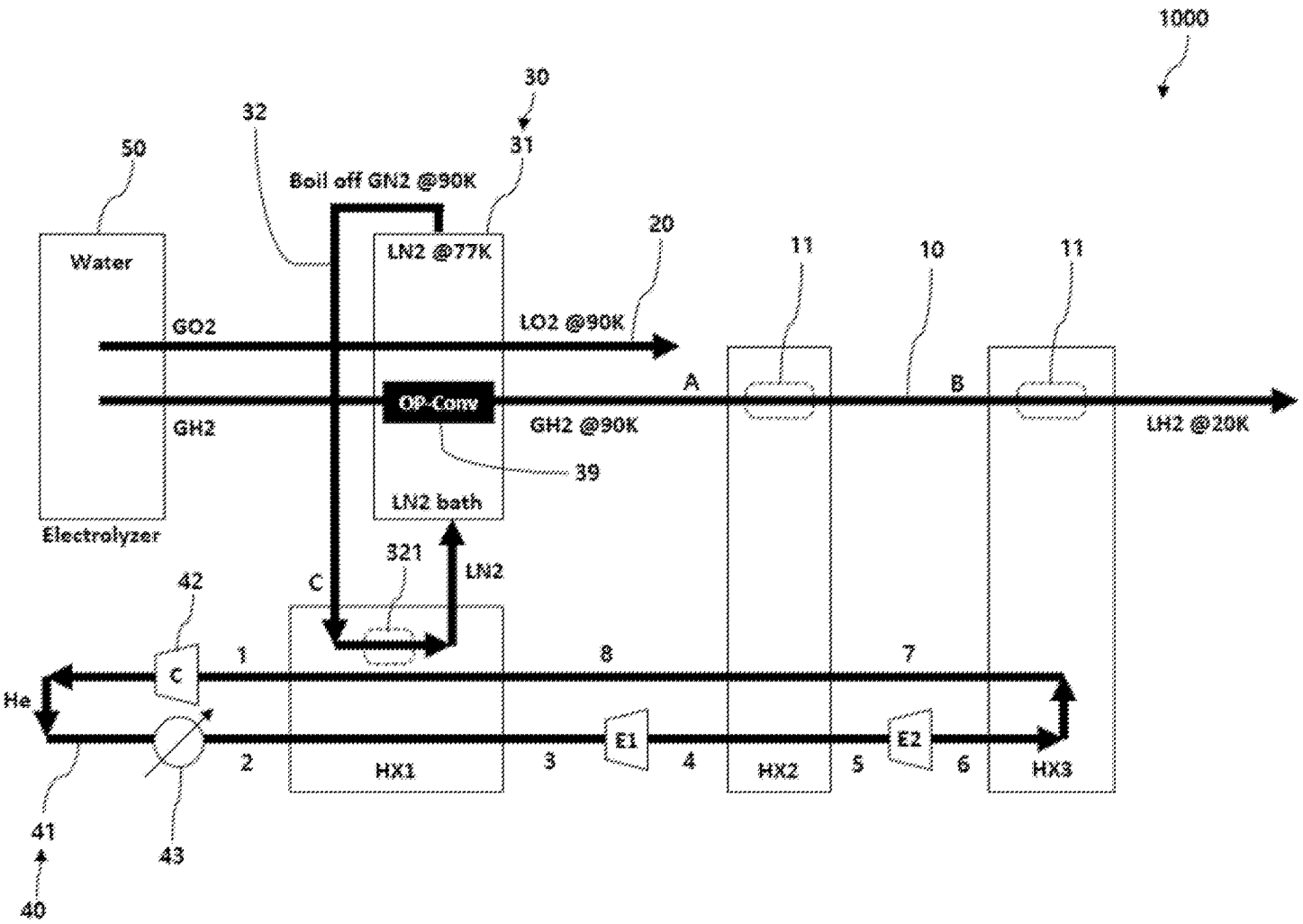
FIG. 1 is a schematic diagram conceptually showing a hydrogen liquefaction system according to an embodiment of the present disclosure.

Hereinafter, various preferred embodiments of the present disclosure will be described in detail with reference to the appended drawings.

The embodiments of the present disclosure are provided to more completely explain the present disclosure to those skilled in the art, and the following embodiments can be modified into various other forms, and the scope of the present disclosure is not limited to the following embodiments. Instead, these embodiments are provided to enhance the faithfulness and completeness of the present disclosure and to fully convey the technical ideas of the present disclosure to those skilled in the art. Furthermore, the thickness and size of each layer in the drawings are exaggerated for convenience and clarity of explanation.

Hereinafter, embodiments of the present disclosure will now be described with reference to drawings that schematically show ideal embodiments of the present disclosure. In the drawings, variations of the depicted shape may be expected, for example, depending on manufacturing technology and/or tolerances. Accordingly, embodiments of the present disclosure should not be construed as being limited to the specific shape of the area shown in this specification, but should include, for example, changes in shape resulting from manufacturing.

Figure 2:
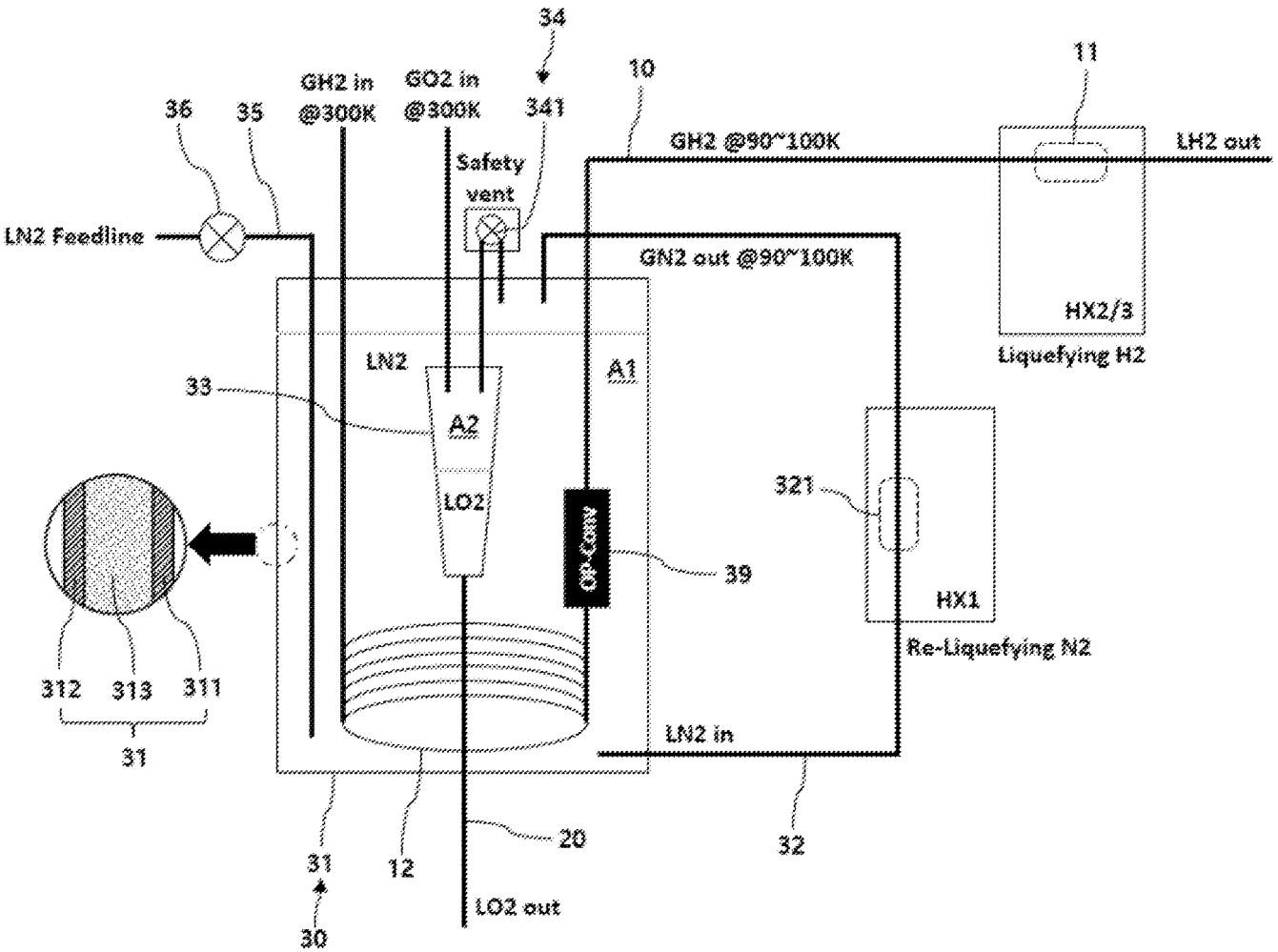
FIG. 2 is a schematic diagram conceptually showing an example of a pre-cooling device of the hydrogen liquefaction system of FIG. 1.
Figure 3:
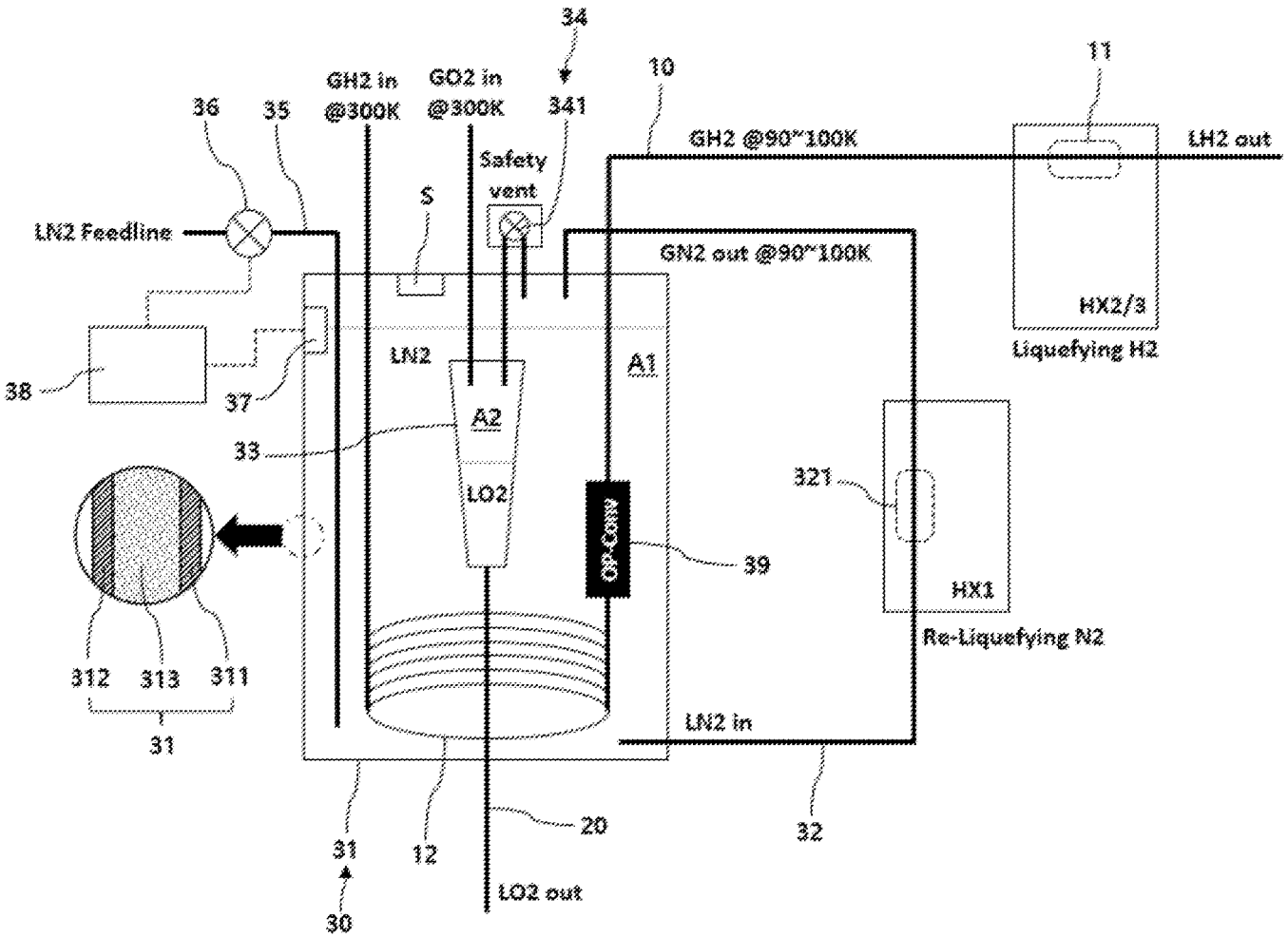
FIG. 3 is a schematic diagram conceptually showing another example of the pre-cooling device of the hydrogen liquefaction system of FIG. 1.
Figure 4:
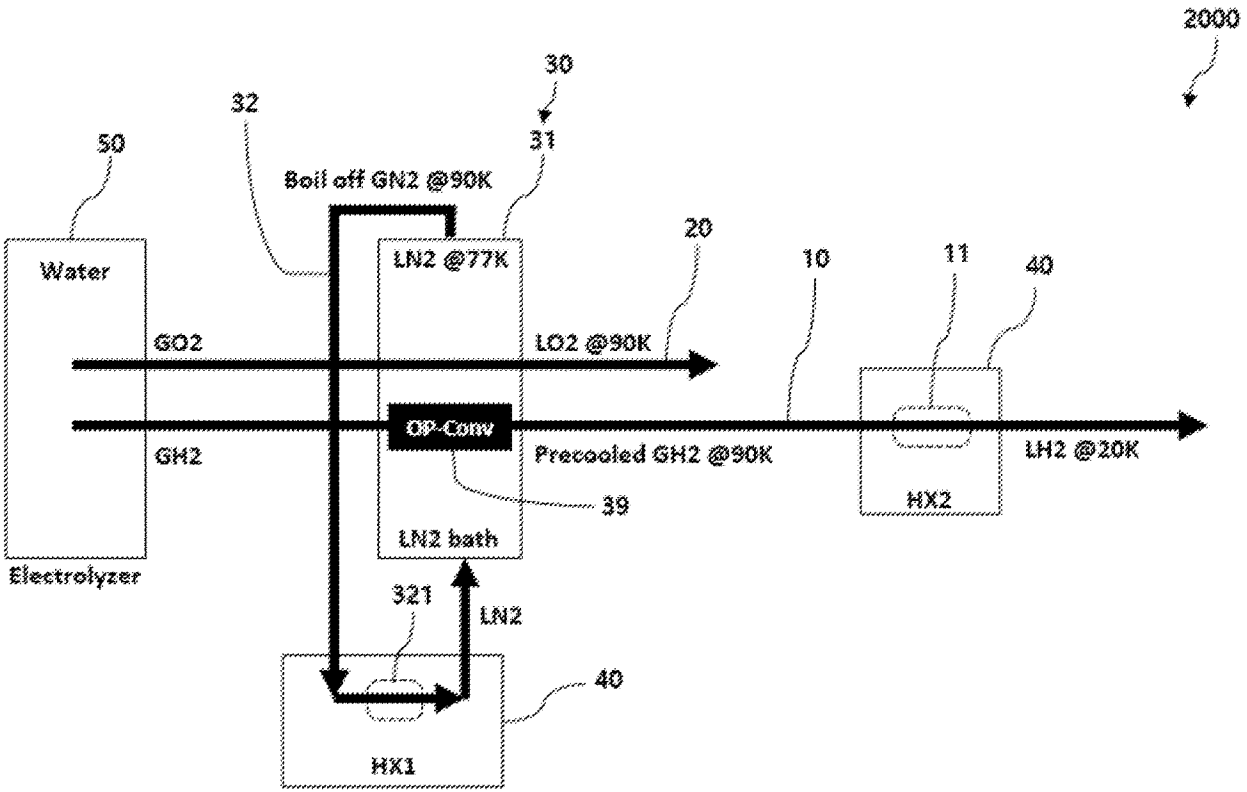
FIG. 4 is a schematic diagram conceptually showing a hydrogen liquefaction system according to other embodiment of the present disclosure.

FIG. 1 is a schematic diagram conceptually showing a hydrogen liquefaction system 1000 according to an embodiment of the present disclosure, FIG. 2 is a schematic diagram conceptually showing an example of a pre-cooling device 30 of the hydrogen liquefaction system 1000 of FIG. 1, and FIG. 3 is a schematic diagram conceptually showing another example of the pre-cooling device 30 of the hydrogen liquefaction system 1000 of FIG. 1. Furthermore, FIG. 4 is a schematic diagram conceptually showing a hydrogen liquefaction system 2000 according to other embodiment of the present disclosure.

First, as shown in FIG. 1, the hydrogen liquefaction system 1000 according to an embodiment of the present disclosure may primarily comprise a hydrogen pipe 10, an oxygen pipe 20, a pre-cooling device 30, and a heat exchange device 40.

As shown in FIG. 1, the hydrogen pipe 10 may form a type of a hydrogen transport pathway that can transport gaseous hydrogen GH2 or liquid hydrogen LH2, and may be applied with various hydrogen lines or hydrogen transport pipes or hydrogen ducts that have sufficient strength and durability to withstand high pressure or low temperature.

The hydrogen pipe 10 may be formed long in a longitudinal direction from a front end to a rear end, and gaseous hydrogen GH2 may be introduced at the front, and heat exchange may be performed at the first heat exchange unit 11 in a middle to liquefy gaseous hydrogen GH2, and liquefied liquid hydrogen LH2 can be discharged at the rear end.

However, the hydrogen pipe 10 is not necessarily limited to FIG. 1, and may be bent into various shapes or formed into various three-dimensional shapes to suit an installation environment.

Accordingly, if the hydrogen pipe 10 is used, gaseous hydrogen GH2 may flow into the front end and pass through the heat exchange unit 11 in the middle, such that gaseous hydrogen GH2 can be liquefied into liquid hydrogen LH2, and then liquefied liquid hydrogen LH2 can be continuously or intermittently discharged through the rear end.

As shown in FIG. 1, the oxygen pipe 20 may form a type of an oxygen transport pathway that can transport gaseous oxygen GO2 or liquid oxygen LO2, and may be applied with various oxygen lines or oxygen transport pipes or oxygen ducts that have sufficient strength and durability to withstand high pressure or low temperature.

The oxygen pipe 20 may be formed long in a longitudinal direction from a front end to a rear end, and gaseous oxygen GO2 may be introduced at the front, heat exchange may be performed at a pre-cooling device 30 in a middle to liquefy gaseous oxygen GO2, and liquefied liquid oxygen LO2 can be discharged at the rear end.

However, the oxygen pipe 20 is not necessarily limited to FIG. 1, and may be bent into various shapes or formed into various three-dimensional shapes to suit an installation environment so as to pass through the pre-cooling device 30.

Accordingly, if the oxygen pipe 20 is used, gaseous oxygen GO2 may flow into the front end and pass through the pre-cooling device 30 in the middle, such that gaseous oxygen GO2 can be liquefied into liquid oxygen LO2, and then liquefied liquid oxygen LO2 can be continuously or intermittently discharged through the rear end.

These front end of the hydrogen pipe 10 and the front end of the oxygen pipe 20 can be connected to an electrolyzer 50, respectively, which electrolyzes water to generate gaseous hydrogen GH2 and gaseous oxygen GO2.

Accordingly, when gaseous hydrogen GH2 and gaseous oxygen GO2 are generated by electrolysis of water in the electrolyzer 50, gaseous hydrogen GH2 and gaseous oxygen GO2 flow into the front end of the hydrogen pipe 10 and the front end of the oxygen pipe 20, respectively, such that they may pass through the pre-cooling device 30, in which liquid nitrogen LN2 is accommodated, through the hydrogen pipe 10 and the oxygen pipe 20 that are separately formed.

As such, during a process of passing through the pre-cooling device 30, heat exchange occurs at 77K which is temperature of liquid nitrogen LN2, such that pre-cooled gaseous hydrogen GH2 and liquefied liquid oxygen LO2 may be discharged, respectively, at approximately 90K (based on 1 bar).

At this time, liquid oxygen LO2, which passes through the pre-cooling device 30 to be discharged through the rear end, may be transported to an external liquid oxygen storage tank (not shown) and then separately stored.

Furthermore, pre-cooled gaseous hydrogen GH2, which passes through the pre-cooling device 30 to be discharged through the hydrogen pipe 10, may be continuously transported to the heat exchange device 40 through the hydrogen pipe 10, and may undergo a separate liquefaction stage according to a recuperative or regenerative heat exchange cycle method.

Liquid hydrogen LH2, which is liquefied in a process of passing through the heat exchange device 40 to be discharged through the rear end, may be stored in a separate liquid hydrogen storage tank (not shown).

As shown in FIG. 1, the pre-cooling device 30 may be formed both between the front end of the hydrogen pipe 10 and the first heat exchange unit 11 and between the front end and the rear end of the oxygen pipe 20 so as to pre-cool gaseous hydrogen GH2 and liquefy gaseous oxygen GO2 before full-scale heat exchange is performed by the heat exchange device 40.

The pre-cooling device 30 may use low-temperature liquid nitrogen LN2, or latent heat that is generated when liquid nitrogen LN2 is vaporized into gaseous nitrogen GN2, to pre-cool gaseous hydrogen GH2 and liquefy gaseous oxygen GO2 into liquid oxygen LO2.

Furthermore, the pre-cooling device 30 may be in thermal contact with the hydrogen pipe 10 and the oxygen pipe 20 so as to perform heat exchange with the hydrogen pipe 10 and the oxygen pipe 20, and may have one side from which liquid nitrogen LN2 is supplied and other side to which gaseous nitrogen GN2 is discharged, by a nitrogen circulating line 32 where heat exchange occurs in a second heat exchange unit 321 leading to liquefaction of gaseous nitrogen GN2 into liquid nitrogen LN2.

More specifically, as shown in FIG. 1 and FIG. 2, a heat exchange tank 31 of the pre-cooling device 30 may be formed to surround at least a portion of the hydrogen pipe 10 and the oxygen pipe 20 so as to perform heat exchange with the hydrogen pipe 10 and the oxygen pipe 20, and have an accommodation space A1 therein so as to accommodate liquid nitrogen LN2.

The heat exchange tank 31, as shown in an enlarged portion of FIG. 2, may comprise an internal tank 311 formed therein; an external tank 312 formed to surround the internal tank 311 so as to be spaced apart from the internal tank 311; and an insulating material 313 formed between the internal tank 311 and the external tank 312.

The internal tank 311 and the external tank 312 may be a hollow double box-shaped structure that has sufficient strength and durability to withstand thermal deformation at cryogenic temperature and pressure differences between an interior and exterior. The insulating material 313 may be applied with insulating foam, glass fiber, aerosol, polymer material, aluminum foil, or the like capable of insulating at cryogenic temperature.

However, the heat exchange tank 31 is not necessarily limited to FIG. 2, and may be applied with a wide variety of shapes of structures having sufficient strength and durability to withstand thermal deformation at cryogenic temperature and pressure differences between an interior and an exterior.

Furthermore, in such heat exchange tank 31, at least a part of the hydrogen pipe 10 may be formed as a spiral section 12 within the accommodation space A1 so as to increase a thermal contact area in contact with liquid nitrogen LN2 that is accommodated in the accommodation space A1 of the heat exchange tank 31.

However, such spiral section 12 of the hydrogen pipe 10 is not necessarily limited to FIG. 2, and may be applied with a wide variety of shapes of multi-surface structures, including a bent section that is bent in a zigzag pattern or branched or joined shapes of fine pipes.

The nitrogen circulating line 32 may connect a lower side and an upper side of the heat exchange tank 31 in a form of a closed loop, and perform heat exchange in the second heat exchange unit 321 leading to liquefaction of gaseous nitrogen GN2 into liquid nitrogen LN2.

Accordingly, the pre-cooling device 30 allows liquid nitrogen LN2 to be supplied to the lower side of the heat exchange tank 31 and gaseous nitrogen GN2 to be discharged to the upper side of the heat exchange tank 31 by the nitrogen circulating line 32.

The oxygen liquefaction tank 33 may be formed on the oxygen pipe 20 in the accommodation space A1 of the heat exchange tank 31, forming a liquefaction space A2 where gaseous oxygen GO2 can be liquefied into liquid oxygen LO2 by heat exchange with liquid nitrogen LN2 that is accommodated in the accommodation space A1.

The pressure regulator 34 may regulate internal pressure of the accommodation space A1 of the heat exchange tank 31 and the liquefaction space A2 of the oxygen liquefaction tank 33.

For example, the pressure regulator 34 may comprise a relief valve 341 that is opened to discharge evaporation gas to outside when internal pressure exceeds a predetermined maximum pressure by evaporation gas generated in at least one of the accommodation space A1 of the heat exchange tank 31 and the liquefaction space A2 of the oxygen liquefaction tank 33.

Furthermore, the pre-cooling device 30 may further comprise a liquid nitrogen supply pipe 35 formed to penetrate the upper side of the heat exchange tank 31 and extend toward the lower side of the heat exchange tank 31 in the accommodation space A1, supplying liquid nitrogen LN2 to the heat exchange tank 31 from outside.

This liquid nitrogen supply pipe 35 may have an on-off valve 36 such that a supply amount of liquid nitrogen LN2 that is supplied through the liquid nitrogen supply pipe 35 can be regulated.

Furthermore, the pre-cooling device 30 may further comprise an Ortho-Para (O-P) converter 39 formed in the hydrogen pipe 10 in the accommodation space A1 of the heat exchange tank 31, converting a ratio of ortho-hydrogen to para-hydrogen in a process of pre-cooling gaseous hydrogen GH2.

The O-P converter 39 may be formed at a rear end of the spiral section 12 where heat exchange occurs in the hydrogen pipe 10 within the accommodation space A1, and may be a catalytic device that converts a ratio of ortho-hydrogen to para-hydrogen.

This O-P converter 39 may have a reaction space equipped with a catalyst in contact with gaseous hydrogen GH2 flowing therein, convert a ratio of ortho-hydrogen to para-hydrogen of hydrogen from chemical reaction of the catalyst in contact with gaseous hydrogen GH2, and be applied with a wide variety of catalysts and catalytic converters with reaction spaces of various structures.

In addition to this, as shown in FIG. 3, the pre-cooling device 30 may further comprise a level detecting sensor 37 that detects a level of liquid nitrogen LN2 that is accommodated in the accommodation space A1 of the heat exchange tank 31, and a control unit 38 that receives a level signal from the level detecting sensor 37 to apply the control signal to the on-off valve 36.

For example, the control unit 38 may raise the level of liquid nitrogen LN2 by applying a control signal that opens the on-off valve 36 when the level signal from the level detecting sensor 37 indicates a low signal that is lower than a reference range. Conversely, the control unit 38 may lower the level of liquid nitrogen LN2 by applying a control signal that closes the on-off valve 36 when the level signal from the level detecting sensor 37 indicates a high signal that is higher than a reference range.

Furthermore, the pre-cooling device 30 may further comprise a temperature sensor S that measures temperature of the heat exchange tank 31.

Accordingly, the control unit 38 may control liquid nitrogen LN2 at a cryogenic state to be additionally supplied to the heat exchange tank 31 through the liquid nitrogen supply pipe 35 according to the temperature signal applied from the temperature sensor S, or control flow rate of gaseous nitrogen GN2 that circulates through the nitrogen circulating line 32 to be discharged from the heat exchange tank 31 or flow rate of introducing liquid nitrogen LN2.

Accordingly, through this pre-cooling device 30 using liquid nitrogen LN2, gaseous hydrogen GH2 can be pre-cooled in advance before full-scale heat exchange is performed by the heat exchange device 40 such that amount of liquefied hydrogen can be significantly increased by reducing refrigeration load on room temperature of the heat exchange device 40. Furthermore, at the same time, gaseous oxygen GO2 may be pre-cooled to be liquefied into liquid oxygen LO2.

For example, gaseous hydrogen GH2 and gaseous oxygen GO2 generated by electrolysis in the electrolyzer 50 may pass through the pre-cooling device 30 through the hydrogen pipe 10 and the oxygen pipe 20, respectively, in a state where temperature is between 200K and 400K, pressure is less than or equal to 10 bar, or pressure is greater than or equal to that pressure when using a separate compressor.

In a process of passing through the pre-cooling device 30, gaseous oxygen GO2 may be liquefied at cryogenic temperature through thermodynamic processing using liquid nitrogen LN2 as a refrigerant. Furthermore, liquid nitrogen LN2 may serve to pre-cool gaseous hydrogen GH2 for liquefying gaseous hydrogen GH2 and convert ortho-hydrogen into para-hydrogen.

As such, liquid oxygen LO2 and gaseous hydrogen GH2, which are discharged by heat exchange in the pre-cooling device 30 that uses liquid nitrogen LN2 as a refrigerant, may have temperature of 90K±10K, and at that temperature, oxygen may undergo a phase change from gas to liquid, and hydrogen may be a cold gas in a para state.

As shown in FIG. 1, the heat exchange device 40 may be a device in thermal contact with the first heat exchange unit 11 of the hydrogen pipe 10 so as to perform heat exchange with the first heat exchange unit 11 of the hydrogen pipe 10 in a recuperative cycle method such that pre-cooled gaseous hydrogen GH2 can be liquefied into liquid hydrogen LH2.

This heat exchange device 40 may also be in thermal contact with a second heat exchange unit 321 of the nitrogen circulating line 32 so as to perform heat exchange in the second heat exchange unit 321 of the nitrogen circulating line 32 of the pre-cooling device 30 leading to liquefaction of gaseous nitrogen GN2 into liquid nitrogen LN2.

More specifically, the heat exchange device 40 may comprise: a helium circulating line 41 in which helium He circulates in a reverse-Brayton cycle; a compressor 42 formed in the helium circulating line 41, compressing helium He; an aftercooler 43 formed in the helium circulating line 41, cooling compressed helium He and releasing heat; a first expander E1 formed in the helium circulating line 41, expanding compressed helium He such that temperature of helium He is firstly lowered; and a second expander E2 formed in the helium circulating line 41, expanding compressed helium He such that temperature of helium He is secondly lowered.

Furthermore, the heat exchange device 40 may comprise a first heat exchanger HX1 formed between the aftercooler 43 and the first expander E1, performing heat exchange with the nitrogen circulating line 32 and the helium circulating line 41 that enter the compressor 42; a second heat exchanger HX2 formed between the first expander E1 and the second expander E2, performing heat exchange with the hydrogen pipe 10; and a third heat exchanger HX3 formed between the second expander E2 and the second heat exchanger HX2, performing heat exchange with the hydrogen pipe 10.

Therefore, according to the heat exchange device 40, as shown in FIG. 1, helium He circulates along the helium circulating line 41 passing through the compressor 42 and aftercooler 43 in a first pathway, the first heat exchanger HX1 in a second pathway, the first expander E1 in a third pathway, the second heat exchanger HX2 in a fourth pathway, the second expander E2 in a fifth pathway, the third heat exchanger HX3 in a sixth pathway, the second heat exchanger HX2 in a seventh pathway, the first heat exchanger HX1 in a eighth pathway, and the compressor 42 in the first pathway again, thereby forming a Cold Box using latent heat that is generated when compressed helium He expands.

Here, the hydrogen pipe 110 may be pre-cooled by the pre-cooling device 30, and then each of the first heat exchange units 11 may be in thermal contact with the second heat exchanger HX2 in 'A' pathway and the third heat exchanger HX3 in 'B' pathway so as to perform heat exchange, such that gaseous hydrogen GH2 can be liquefied into liquid hydrogen LH2.

Furthermore, in the nitrogen circulating line 32 of the pre-cooling device 30, the second heat exchange unit 321 may be in thermal contact with the first heat exchanger HX1 in 'C' pathway to perform heat exchange, such that gaseous nitrogen GN2 used as a refrigerant can be liquefied into liquid nitrogen LN2.

However, the heat exchange device 40 is not limited to the recuperative cycle method in FIG. 1, and may be applied with a wide variety of types and shapes of cooling cycle devices capable of liquefying gaseous hydrogen GH2 into liquid hydrogen LH2 and liquefying gaseous nitrogen GN2, which is used as a refrigerant in the pre-cooling device 30, into liquid nitrogen LN2.

For example, as shown in FIG. 4, the heat exchange device 40 may liquefy gaseous hydrogen GH2 into liquid hydrogen LH2 in a regenerative cycle method, and may liquefy gaseous nitrogen GN2, which is used as a refrigerant in the pre-cooling device 30, into liquid nitrogen LN2.

More specifically, the heat exchange device 40 may comprise a first heat exchanger HX1 formed in the nitrogen circulating line 32 to perform heat exchange with the second heat exchange unit 321 of the nitrogen circulating line 32 by a cryocooler (not shown); and a second heat exchanger HX2 formed in the hydrogen pipe 10 to perform heat exchange with the first heat exchange unit 11 of the hydrogen pipe 10 by the cryocooler.

As such, the first heat exchanger HX1 and the second heat exchanger HX2 performing heat exchange by the cryocooler are not limited to a specific heat exchange method, but all types of heat exchange methods capable of performing heat exchange between the cryocooler and the heat exchange units 11, 321, such as a double pipe heat exchange method using a heat pipe, a fin heat exchange method using conductive cooling, a plate heat exchange method, etc. may be applied.

Accordingly, the first heat exchanger HX1 and the second heat exchanger HX2 may liquefy gaseous hydrogen GH2 or gaseous nitrogen GN2, which flow along the hydrogen pipe 10 or the nitrogen circulating line 32, by cooling liquefy gaseous hydrogen GH2 or gaseous nitrogen GN2 through heat exchange with the cryocooler.

Furthermore, in the aforementioned embodiment, the heat exchange device 40 is exemplified as liquefying gaseous hydrogen GH2 into liquid hydrogen LH2 by comprising only a single second heat exchanger HX2 in the hydrogen pipe 10, however, it is not necessarily limited to FIG. 4, and may comprise a various numbers of plurality of heat exchangers in the hydrogen pipe 10 considering the refrigeration capacity of the cryocooler or a required amount of liquefied hydrogen.

Figure 5:
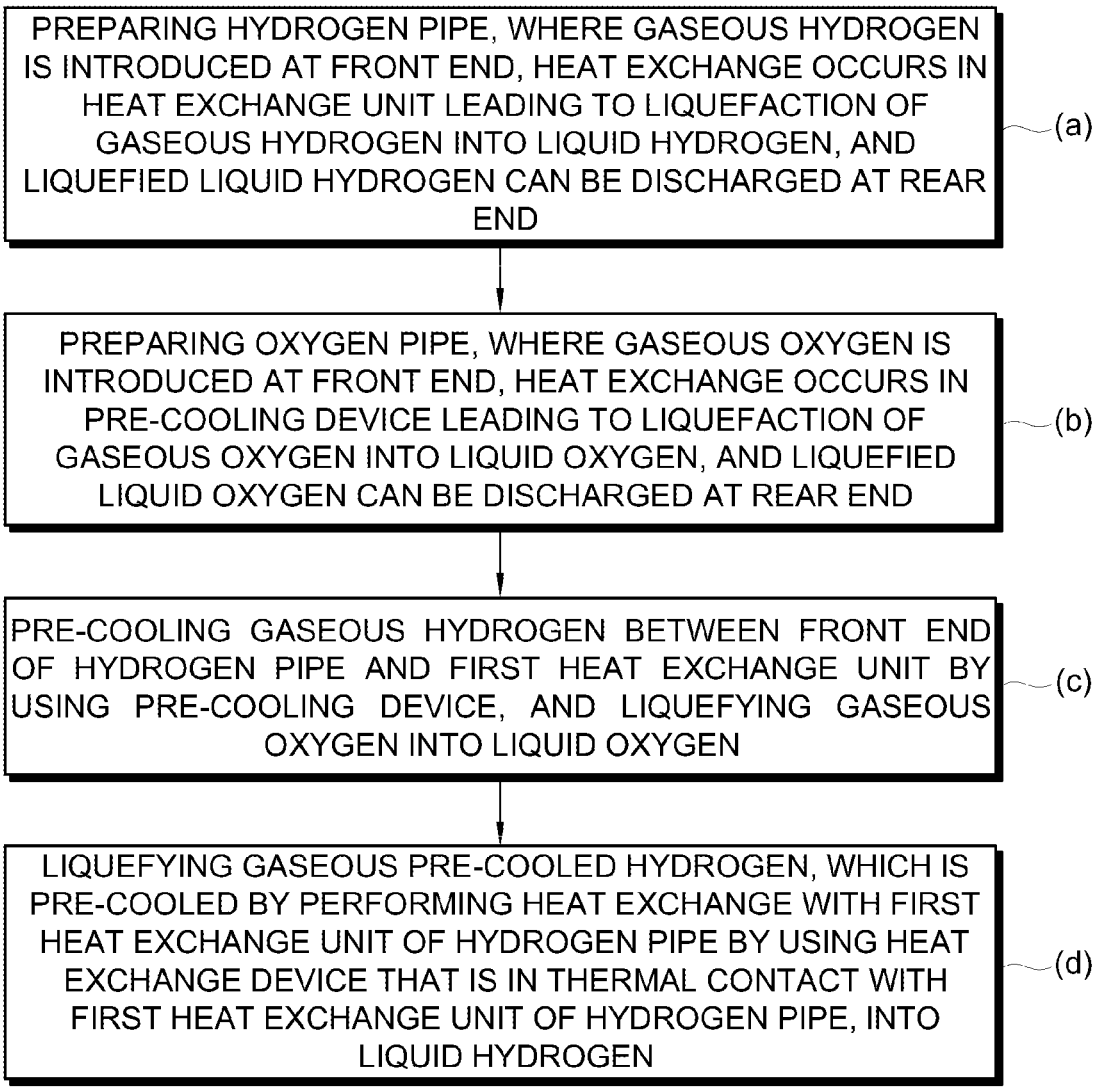
FIG. 5 is a flowchart showing a hydrogen liquefaction method according to another embodiment of the present disclosure.

FIG. 5 is a flowchart showing a hydrogen liquefaction method according to another embodiment of the present disclosure.

As shown in FIG. 5, a hydrogen liquefaction method according to another embodiment of the present disclosure may comprise: (a) preparing a hydrogen pipe, where gaseous hydrogen GH2 is introduced at a front end, heat exchange occurs in a heat exchange unit 11 leading to liquefaction of gaseous hydrogen GH2 into liquid hydrogen LH2, and liquefied liquid hydrogen LH2 can be discharged at a rear end; (b) preparing an oxygen pipe, where gaseous oxygen GO2 is introduced at a front end, heat exchange occurs in a pre-cooling device 30 leading to liquefaction of gaseous oxygen GO2 into liquid oxygen LO2, and liquefied liquid oxygen LO2 can be discharged at a rear end; (c) pre-cooling gaseous hydrogen GH2 between the front end of the hydrogen pipe 10 and the first heat exchange unit 11 by using the pre-cooling device 30, and liquefying gaseous oxygen GO2 into liquid oxygen LO2; and (d) liquefying gaseous pre-cooled hydrogen GH2, which is pre-cooled by performing heat exchange with the first heat exchange unit 11 of the hydrogen pipe 10 by using a heat exchange device 40 that is in thermal contact with the first heat exchange unit 11 of the hydrogen pipe 10, into liquid hydrogen.

Therefore, according to the hydrogen liquefaction systems 1000, 2000 and hydrogen liquefaction method according to various embodiments of the present disclosure, it is possible to simultaneously liquefy gaseous oxygen GO2 in a pre-cooling process to increase an amount of liquefied hydrogen by connecting a separate oxygen pipe 20, in which heat exchange can occur, to the pre-cooling device 30 that pre-cools gaseous hydrogen GH2 using liquid nitrogen LN2.

As such, simple improvement of a pipe connection structure for additional heat exchange in a pre-cooling stage that is used in a liquefaction stage of gaseous hydrogen GH2 allows simultaneous pre-cooling of gaseous hydrogen GH2 and liquefaction of gaseous oxygen GO2, such that gaseous oxygen GO2 can be liquefied together, which is generated as a by-product during water electrolysis at minimal cost without additional equipment.

Although the above has shown and described various embodiments of the present disclosure, the present disclosure is not limited to the specific embodiments described above. The above-described embodiments can be variously modified and implemented by those skilled in the art to which the present invention pertains without departing from the gist of the present disclosure claimed in the appended claims, and these modified embodiments should not be understood separately from the technical spirit or scope of the present disclosure. Therefore, the technical scope of the present disclosure should be defined only by the appended claims.

In the embodiments disclosed herein, arrangement of illustrated components may vary depending on requirements or environment in which the invention is implemented. For example, some components may be omitted or some components may be integrated and implemented as one.

What is claimed is:

1. A hydrogen liquefaction system, comprising:

a hydrogen pipe, where gaseous hydrogen is introduced at a front end, heat exchange occurs in a first heat exchange unit leading to liquefaction of gaseous hydrogen into liquid hydrogen, and liquefied liquid hydrogen can be discharged at a rear end;

a pre-cooling device formed between the front end of the hydrogen pipe and the first heat exchange unit, pre-cooling gaseous hydrogen;

an oxygen pipe, where gaseous oxygen is introduced at a front end, heat exchange occurs in the pre-cooling device leading to liquefaction of gaseous oxygen into liquid oxygen, and liquefied liquid oxygen can be discharged at a rear end; and a heat exchange device, which is in thermal contact with the first heat exchange unit of the hydrogen pipe so as to perform heat exchange with the first heat exchange unit of the hydrogen pipe such that pre-cooled gaseous hydrogen can be liquefied into liquid hydrogen.

2. The hydrogen liquefaction system according to claim 1, wherein the pre-cooling device uses low-temperature liquid nitrogen, or latent heat that is generated when liquid nitrogen is vaporized into gaseous nitrogen, to pre-cool gaseous hydrogen and liquefy gaseous oxygen into liquid oxygen.

3. The hydrogen liquefaction system according to claim 2, wherein the pre-cooling device is in thermal contact with the hydrogen pipe and the oxygen pipe so as to perform heat exchange with the hydrogen pipe and the oxygen pipe, and has one side from which liquid nitrogen is supplied and other side to which gaseous nitrogen is discharged, by a nitrogen circulating line where heat exchange occurs in a second heat exchange unit leading to liquefaction of gaseous nitrogen into liquid nitrogen.

4. The hydrogen liquefaction system according to claim 3, wherein the heat exchange device is in thermal contact with the second heat exchange unit of the nitrogen circulating line so as to perform heat exchange with the second heat exchange unit of the nitrogen circulating line to liquefy gaseous nitrogen into liquid nitrogen.

5. The hydrogen liquefaction system according to claim 2, wherein the pre-cooling device comprises:

a heat exchange tank formed to surround at least a part of the hydrogen pipe and the oxygen pipe so as to perform heat exchange with the hydrogen pipe and the oxygen pipe, and has an accommodation space therein so as to accommodate liquid nitrogen;

a nitrogen circulating line that connects a lower side and an upper side of the heat exchange tank in a form of a closed loop, and performs heat exchange in a second heat exchange unit leading to liquefaction of gaseous nitrogen into liquid nitrogen such that liquid nitrogen can be supplied to the lower side of the heat exchange tank and gaseous nitrogen can be discharged to the upper side of the heat exchange tank; and an oxygen liquefaction tank formed in the oxygen pipe in the accommodation space of the heat exchange tank, forming a liquefaction space where gaseous oxygen can be liquefied into liquid oxygen by heat exchange with liquid nitrogen that is accommodated in the accommodation space.

6. The hydrogen liquefaction system according to claim 5, wherein the heat exchange tank comprises:

an internal tank formed therein;

an external tank formed to surround the internal tank so as to be spaced apart from the internal tank; and an insulating material formed between the internal tank and the external tank.

7. The hydrogen liquefaction system according to claim 5, wherein at least a part of the hydrogen pipe is formed as a spiral section within the accommodation space so as to increase a thermal contact area in contact with liquid nitrogen that is accommodated in the accommodation space of the heat exchange tank.

8. The hydrogen liquefaction system according to claim 5, wherein the pre-cooling device further comprises a pressure regulator that regulates internal pressure of the accommodation space of the heat exchange tank and internal pressure of the liquefaction space of the oxygen liquefaction tank.

9. The hydrogen liquefaction system according to claim 8, wherein the pressure regulator comprises a relief valve that is opened to discharge evaporation gas to outside when internal pressure exceeds a predetermined maximum pressure by evaporation gas generated in at least one of the accommodation space of the heat exchange tank and the liquefaction space of the oxygen liquefaction tank.

10. The hydrogen liquefaction system according to claim 5, wherein the pre-cooling device further comprises:

a liquid nitrogen supply pipe formed to penetrate the upper side of the heat exchange tank and extend toward the lower side of the heat exchange tank in the accommodation space, supplying liquid nitrogen to the heat exchange tank from outside; and an on-off valve formed in the liquid nitrogen supply pipe so as to control a supply amount of liquid nitrogen that is supplied through the liquid nitrogen supply pipe.

11. The hydrogen liquefaction system according to claim 10, wherein the pre-cooling device further comprises:

a level detecting sensor that detects a level of liquid nitrogen that is accommodated in the accommodation space of the heat exchange tank; and a control unit that receives a level signal from the level detecting sensor to apply a control signal to the on-off valve.

12. The hydrogen liquefaction system according to claim 5, wherein the pre-cooling device further comprises an Ortho-Para (O-P) converter formed in the hydrogen pipe in the accommodation space of the heat exchange tank, converting a ratio of ortho-hydrogen to para-hydrogen in a process of pre-cooling gaseous hydrogen.

13. The hydrogen liquefaction system according to claim 4, wherein the heat exchange device comprises:

a helium circulating line in which helium circulates;

a compressor formed in the helium circulating line, compressing helium;

an aftercooler formed in the helium circulating line, cooling compressed helium to release heat;

a first expander formed in the helium circulating line, expanding compressed helium such that temperature of helium is firstly lowered; and a second expander formed in the helium circulating line, expanding compressed helium such that temperature of helium is secondly lowered.

14. The hydrogen liquefaction system according to claim 13, wherein the heat exchange device further comprises:

a first heat exchanger formed between the aftercooler and the first expander, performing heat exchange with the nitrogen circulating line and the helium circulating line that enter the compressor;

a second heat exchanger formed between the first expander and the second expander, performing heat exchange with the hydrogen pipe; and a third heat exchanger formed between the second expander and the second heat exchanger, performing heat exchange with the hydrogen pipe.

15. The hydrogen liquefaction system according to claim 4, wherein the heat exchange device comprises:

a first heat exchanger formed in the nitrogen circulating line, performing heat exchange with the nitrogen circulating line; and a second heat exchanger formed in the hydrogen pipe, performing heat exchange with the hydrogen pipe by the cryocooler.

16. The hydrogen liquefaction system according to claim 1, wherein the front end of the hydrogen pipe at which gaseous hydrogen is introduced and the front end of the oxygen pipe at which gaseous oxygen is introduced are connected to an electrolyzer that electrolyzes water to generate gaseous hydrogen and gaseous oxygen.

17. A hydrogen liquefaction system, comprising:

a hydrogen pipe, where gaseous hydrogen is introduced at a front end, heat exchange occurs in a first heat exchange unit leading to liquefaction of gaseous hydrogen into liquid hydrogen, and liquefied liquid hydrogen can be discharged at a rear end;

a pre-cooling device formed between the front end of the hydrogen pipe and the first heat exchange unit, pre-cooling gaseous hydrogen;

an oxygen pipe, where gaseous oxygen is introduced at a front end, heat exchange occurs in the pre-cooling device leading to liquefaction of gaseous oxygen into liquid oxygen, and liquefied liquid oxygen can be discharged at a rear end; and a heat exchange device, which is in thermal contact with the first heat exchange unit of the hydrogen pipe so as to perform heat exchange with the first heat exchange unit of the hydrogen pipe such that pre-cooled gaseous hydrogen can be liquefied into liquid hydrogen;

wherein the pre-cooling device comprises:

a heat exchange tank that uses low-temperature liquid nitrogen, or latent heat that is generated when liquid nitrogen is vaporized into gaseous nitrogen, to pre-cool gaseous hydrogen and liquefy gaseous oxygen into liquid oxygen, is formed to surround at least a part of the hydrogen pipe and the oxygen pipe so as to perform heat exchange with the hydrogen pipe and the oxygen pipe, and has an accommodation space therein so as to accommodate liquid nitrogen;

a nitrogen circulating line that connects a lower side and an upper side of the heat exchange tank in a form of a closed loop, and performs heat exchange in a second heat exchange unit leading to liquefaction of gaseous nitrogen into liquid nitrogen such that liquid nitrogen can be supplied to the lower side of the heat exchange tank and gaseous nitrogen can be discharged to the upper side of the heat exchange tank;

an oxygen liquefaction tank formed in the oxygen pipe in the accommodation space of the heat exchange tank, forming a liquefaction space where gaseous oxygen can be liquefied into liquid oxygen by heat exchange with liquid nitrogen that is accommodated in the accommodation space;

a pressure regulator that regulates internal pressure of the accommodation space of the heat exchange tank and internal pressure of the liquefaction space of the oxygen liquefaction tank;

a liquid nitrogen supply pipe formed to penetrate the upper side of the heat exchange tank and extend toward the lower side of the heat exchange tank in the accommodation space, supplying liquid nitrogen to the heat exchange tank from outside;

an on-off valve formed in the liquid nitrogen supply pipe so as to control a supply amount of liquid nitrogen that is supplied through the liquid nitrogen supply pipe; and an Ortho-Para (O-P) converter formed in the hydrogen pipe in the accommodation space of the heat exchange tank, converting a ratio of ortho-hydrogen to para-hydrogen in a process of pre-cooling gaseous hydrogen; and wherein at least a part of the hydrogen pipe is formed in a spiral shape within the accommodation space so as to increase a thermal contact area in contact with liquid nitrogen that is accommodated in the accommodation space of the heat exchange tank, and the heat exchange device is in thermal contact with the second heat exchange unit of the nitrogen circulating line so as to perform heat exchange with the second heat exchange unit of the nitrogen circulating line leading to liquefaction of gaseous nitrogen into liquid nitrogen, and performs heat exchange with the first heat exchange unit of the hydrogen pipe and the second heat exchange unit of the nitrogen circulating line by a recuperative cycle and a regenerative cycle.

18. A hydrogen liquefaction method, comprising:

(a) preparing a hydrogen pipe, where gaseous hydrogen is introduced at a front end, heat exchange occurs in a first heat exchange unit leading to liquefaction of gaseous hydrogen into liquid hydrogen, and liquefied liquid hydrogen can be discharged at a rear end;

(b) preparing an oxygen pipe, where gaseous oxygen is introduced at a front end, heat exchange occurs in a pre-cooling device leading to liquefaction of gaseous oxygen into liquid oxygen, and liquefied liquid oxygen can be discharged at a rear end;

(c) pre-cooling gaseous hydrogen between the front end of the hydrogen pipe and the first heat exchange unit by using the pre-cooling device, and liquefying gaseous oxygen into liquid oxygen; and (d) liquefying gaseous pre-cooled hydrogen, which is pre-cooled by performing heat exchange with the first heat exchange unit of the hydrogen pipe by using a heat exchange device that is in thermal contact with the first heat exchange unit of the hydrogen pipe, into liquid hydrogen.

* * * * *